US009105425B2

(12) United States Patent
Tsai

(10) Patent No.: US 9,105,425 B2
(45) Date of Patent: Aug. 11, 2015

(54) ELECTRONIC APPARATUS

(71) Applicant: KABUSHIKI KAISHA TOSHIBA, Minato-ku, Tokyo (JP)

(72) Inventor: Brian Tsai, Taipei (TW)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 159 days.

(21) Appl. No.: 14/014,013

(22) Filed: Aug. 29, 2013

(65) Prior Publication Data

US 2014/0116868 A1 May 1, 2014

Related U.S. Application Data

(63) Continuation of application No. PCT/JP2013/068459, filed on Jun. 28, 2013.

(30) Foreign Application Priority Data

Oct. 25, 2012 (JP) ..... 2012-235577

(51) Int. Cl.
*H01H 23/12* (2006.01)
*H01H 21/24* (2006.01)

(52) U.S. Cl.
CPC ..... *H01H 23/12* (2013.01); *H01H 21/24* (2013.01); *H01H 2221/016* (2013.01); *H01H 2221/044* (2013.01); *H01H 2225/026* (2013.01)

(58) Field of Classification Search
CPC ..... H01H 23/12
USPC ..... 200/259, 520, 345, 344, 339, 509, 510, 200/244
See application file for complete search history.

(56) References Cited

U.S. PATENT DOCUMENTS

| | | | | |
|---|---|---|---|---|
| 3,931,487 | A * | 1/1976 | Russenberger | 200/529 |
| 4,037,068 | A * | 7/1977 | Gaynor | 200/5 F |
| 5,500,498 | A * | 3/1996 | Kurek et al. | 200/556 |
| 7,994,447 | B2 * | 8/2011 | Sakai | 200/529 |

FOREIGN PATENT DOCUMENTS

| | | |
|---|---|---|
| JP | 56-28129 | 3/1981 |
| JP | 63-108138 | 7/1988 |
| JP | 02-089732 U1 | 7/1990 |

(Continued)

OTHER PUBLICATIONS

International Search Report and Written Opinion for International Application No. PCT/JP2013/068459, Notification mailed Aug. 10, 2013.

*Primary Examiner* — Edwin A. Leon
(74) *Attorney, Agent, or Firm* — Knobbe, Martens, Olson & Bear LLP

(57) ABSTRACT

According to one embodiment, an electronic apparatus includes a housing, a switch, a button member and a supporting portion. The housing has an opening. The button member includes an operating portion, a rocker shaft and an acting portion. The operating portion is exposed through the opening. The shaft is coupled to the operating portion and pivotable. The acting portion is coupled to the shaft, configured to face the switch and to pivot about the shaft, thereby pressing the switch. The supporting portion is configured to support the button member, the supporting portion being configured to be elastically deformed by part of the button member and to return the button member.

5 Claims, 4 Drawing Sheets

(56) References Cited

FOREIGN PATENT DOCUMENTS

| | | | |
|---|---|---|---|
| JP | 03-104932 | U1 | 10/1991 |
| JP | 04-115733 | U1 | 10/1992 |
| JP | 05-274852 | | 10/1993 |
| JP | 7-16340 | | 3/1995 |

* cited by examiner

ELECTRONIC APPARATUS

CROSS REFERENCE TO RELATED APPLICATIONS

This application is a Continuation Application of PCT Application No. PCT/JP2013/068459, filed Jun. 28, 2013 and based upon and claiming the benefit of priority from Japanese Patent Application No. 2012-235577, filed Oct. 25, 2012, the entire contents of all of which are incorporated herein by reference.

FIELD

Embodiments described herein relate generally to an electronic apparatus.

BACKGROUND

An electronic apparatus, such as a portable computer, comprises various buttons including a power button. If a user depresses a button, the button presses and activates a switch in a housing. Typically, the switch is located immediately below the button.

If the switch is located immediately below the button, the portable computer tends to be thick. Since other components, such as a circuit board, are accommodated in the housing, moreover, the arrangement of the button and switch is limited. Thus, there is still room for improvement in the arrangement of the buttons in the electronic apparatus.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an electronic apparatus includes a housing, a switch in the housing, a button member and a supporting portion in the housing. The housing includes an opening. The switch is configured to be actuated when depressed. The button member includes an operating portion, a rocker shaft and an acting portion. The operating portion is exposed through the opening. The rocker shaft is coupled to the operating portion inside the housing and pivotably held by the housing. The acting portion is coupled to the rocker shaft, configured to face the switch, and configured to pivot about the rocker shaft, thereby pressing the switch, when the operating portion is depressed. The supporting portion is configured to support the button member to thereby restrain pivoting of the button member, the supporting portion being configured to be elastically deformed by part of the button member so that the button member is pivoted about the rocker shaft when the operating portion is pressed and to return the button member when a force applied to the operating portion is removed.

One embodiment will now be described with reference to FIGS. 1 to 6. In this specification, the near or user side is defined as forward; the far side from the user as rearward, the user's left-hand side as leftward, the user's right-hand side as rightward, and the upper and lower sides with respect to the user as upward and downward, respectively. Further, each element that can be expressed in different ways may sometimes be represented by one or more alternative examples of expressions. However, this neither denies that an element that is not given any alternative expression can be differently expressed, nor restricts other expressions that are not exemplified.

Figure 1:
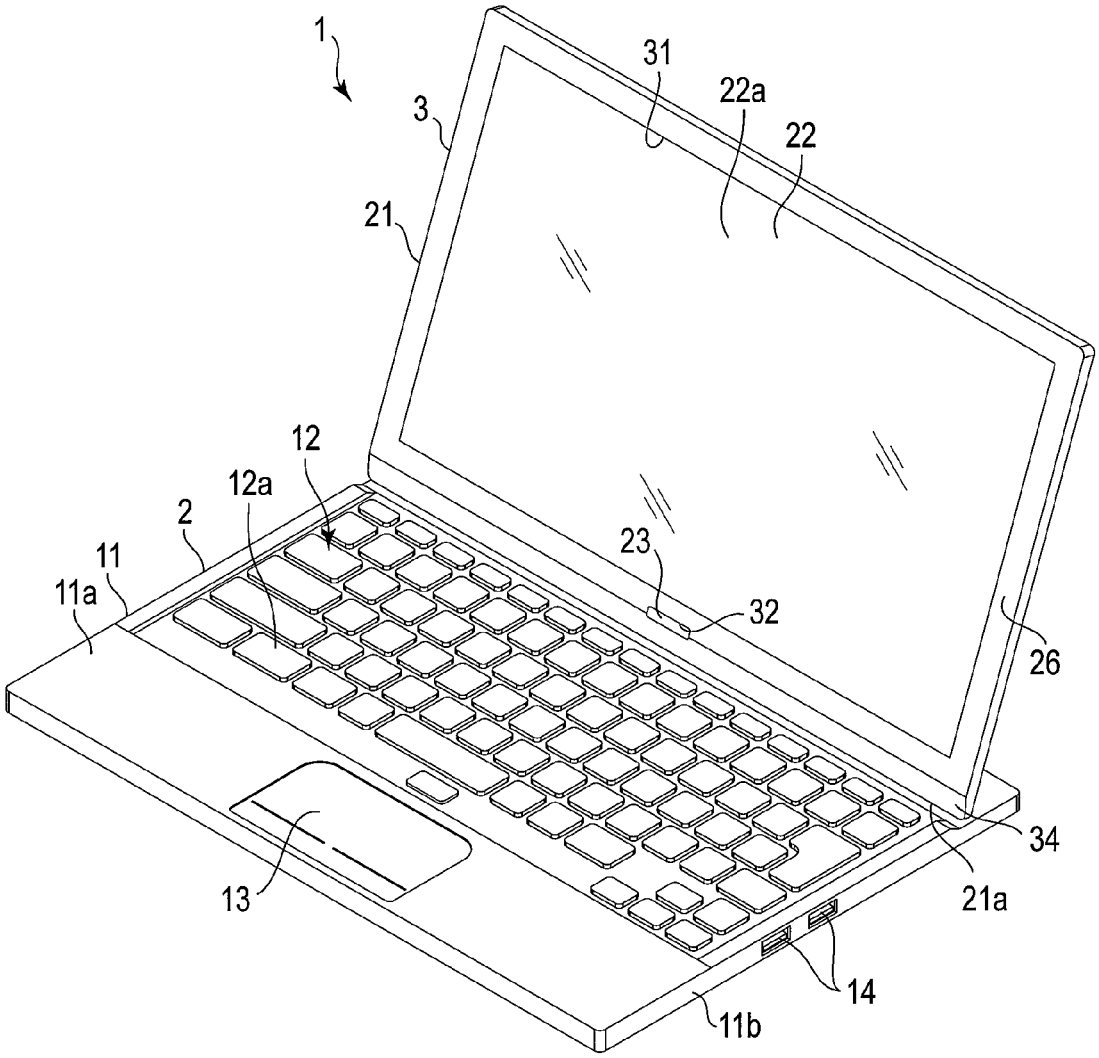
FIG. 1 is an exemplary perspective view showing a portable computer according to one embodiment.

FIG. 1 is a perspective view showing a portable computer 1 according to the one embodiment. The portable computer 1 is an example of an electronic apparatus. As shown in FIG. 1, the computer 1 comprises a main body 2 and display section 3. The main body 2 is also referred to as a first part, base section, or main unit. The display section 3 is also referred to as a second part, display device, or display unit.

The main body 2 comprises a base housing 11, keyboard 12, touch-and-click pad 13, and connectors 14. The base housing 11 is in the form of a rectangular box. The base housing 11 accommodates therein, for example, a motherboard, on which an MPU is mounted, a battery, etc.

The keyboard 12 and touch-and-click pad 13 are disposed on a top surface 11*a* of the base housing 11. The keyboard 12 is used for character input and the operation of the portable computer 1, for example. The keyboard 12 comprises a plurality of key buttons. Of these key buttons, one key button 12*a* is configured to call up, for example, a menu screen of an operating system (OS) when operated by the user. The touch-and-click pad 13 is used for cursor movement, click operation, etc.

The connectors 14 are mounted on the motherboard and exposed through openings in a side surface 11*b* of the base housing 11. The connectors 14 are, for example, USB or HDMI connectors.

The display section 3 comprises a display housing 21, display module 22, and button member 23. The display housing 21 is an example of a housing and is also referred to as an outer shell portion, wall portion, or accommodation portion. The button member 23 is also referred to as an operating member, pivoting member, or member.

Figure 3:
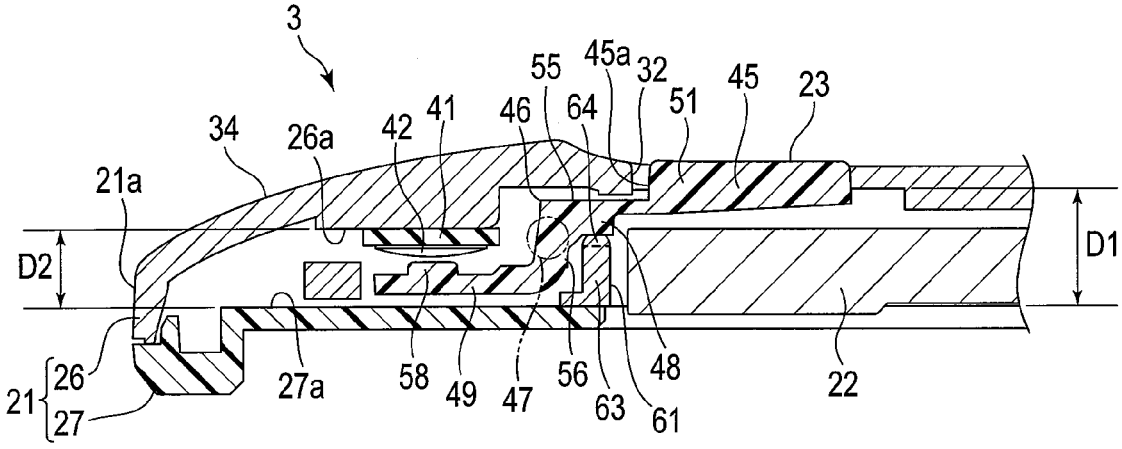
FIG. 3 is an exemplary sectional view showing part of the display section.

The display housing 21 is in the form of a rectangular box, comprising a front cover 26 and rear cover 27 (FIG. 3). The front cover 26 is an example of a cover and is also referred to as an outer wall, wall portion, or covering portion. The front cover 26 is made of, for example, a magnesium alloy. The rear cover 27 is made of, for example, a synthetic resin. The materials of the front and rear covers 26 and 27 are not limited to these ones.

The front cover 26 forms the front and side surfaces of the display housing 21. The rear cover 27 forms the rear surface of the display housing 21. The front cover 26 is secured to the rear cover 27 by, for example, screws to form the display housing 21.

The front cover 26 comprises a display opening 31 and aperture 32. The aperture 32 is also referred to as a hole, open portion, or fitting portion. The display opening 31 is substantially rectangular and is covered by a transparent plate of, for example, glass. The aperture 32 has a substantially rectangular shape smaller than the display opening 31.

The aperture 32 is disposed between the display opening 31 and a lower end portion 21*a* of the display housing 21. The lower end portion 21*a* of the display housing 21 is a part that is directed toward the main body 2 when the display section 3 is located in a position shown in FIG. 1.

A slope 34 is disposed on the front cover 26, ranging from the position of the aperture 32 to the lower end portion 21*a* of the display housing 21. Because of the presence of the slope 34, the display housing 21 is reduced in thickness toward the lower end portion 21*a*.

The display module 22 is accommodated in the display housing 21. The display module 22 comprises a screen 22*a* on which an image is displayed. The screen 22*a* is exposed through the display opening 31.

The display module 22 is, for example, a liquid-crystal display. The display module 22 comprises a touchpanel. The user operates the portable computer 1 by touching the screen 22*a* with a finger or stylus.

The button member 23 is exposed through the aperture 32. If the button member 23, like the key button 12*a*, is operated by the user, the menu screen of the OS, for example, is called up. The button member 23 is not limited to this function and may alternatively be used, for example, as a power button of the portable computer 1 or used to cancel the standby state of the OS.

The display section 3 is coupled to the rear end portion of the main body 2 by a sliding hinge. The sliding hinge enables the display section 3 to move between first and second positions shown in FIG. 1. In the first position, the display section 3 is obliquely raised from the rear end portion of the main body 2.

Figure 2:
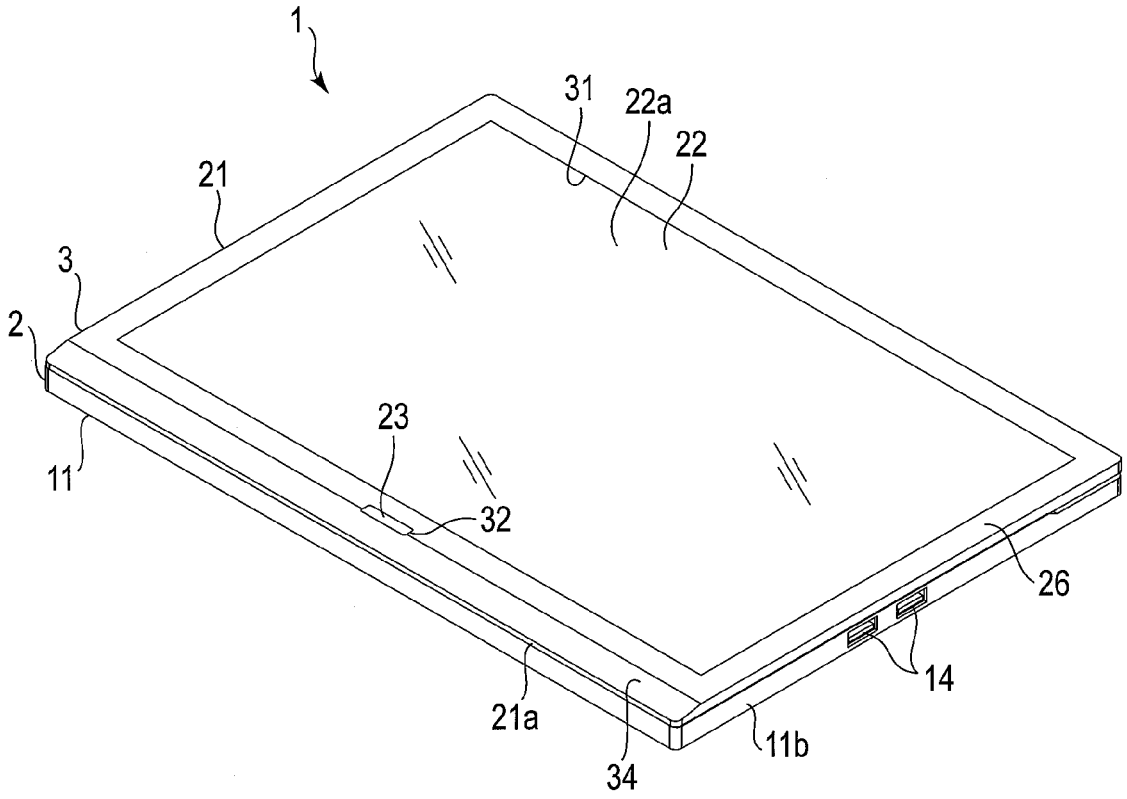
FIG. 2 is an exemplary perspective view showing the portable computer with its display section in a second position.

FIG. 2 is a perspective view showing the portable computer 1 with the display section 3 in the second position. As shown in FIG. 2, the display section 3 in the second position covers the top surface 11*a* of the base housing 11. Thus, the keyboard 12 and touchpad 13 are covered by the display section 3.

The user operates the portable computer 1 by means of the display module 22, which comprises the touchpanel, and the button member 23. In other words, the computer 1 with the display section 3 in the second position is used as a tablet device.

FIG. 3 is a sectional view showing part of the display section 3. As shown in FIG. 3, a switch 41 is mounted on an inner surface 26*a* of the front cover 26. In other words, the switch 41 is disposed within the display housing 21. The inner surface 26*a* of the front cover 26 includes the surface on which the switch 41 is disposed and all other surfaces that face the rear cover 27.

The switch 41 is disposed between the aperture 32 and the lower end portion 21*a* of the display housing 21. In other words, the switch 41 is attached to the slope 34 of the display housing 21. The switch 41 may be located in another position.

The switch 41 comprises a belleville spring portion 42 projecting into the display housing 21. The switch 41 is activated when the spring portion 42 is depressed. The spring portion 42 is elastically deformed if it is subjected to a pressing force of a certain magnitude or greater. If this pressing force is removed, the spring portion 42 is restored to its original shape.

Figure 4:
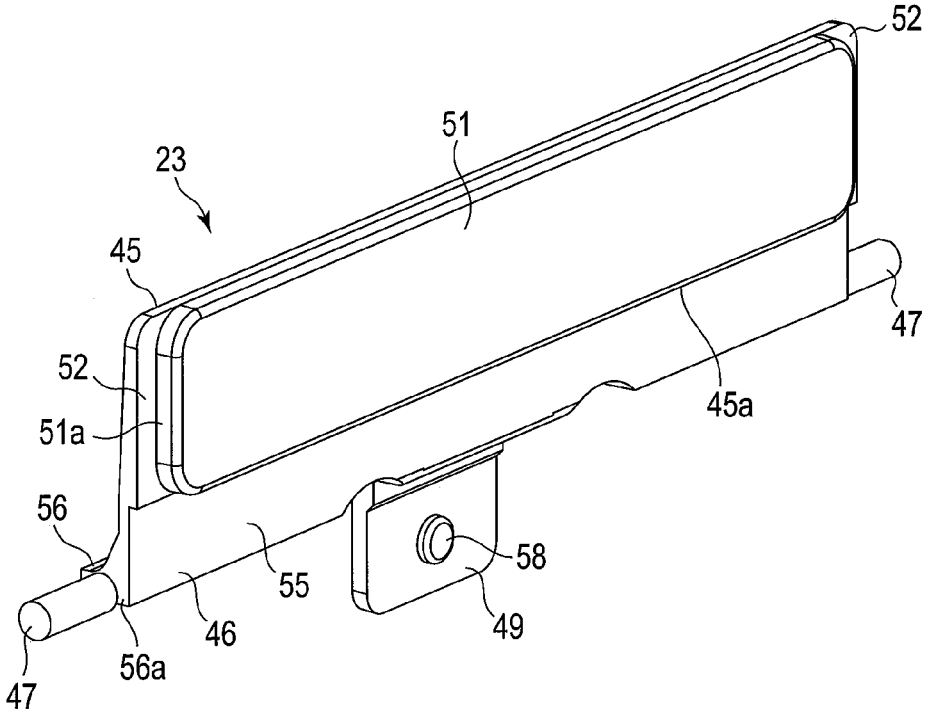
FIG. 4 is an exemplary perspective view showing a button member.
Figure 5:
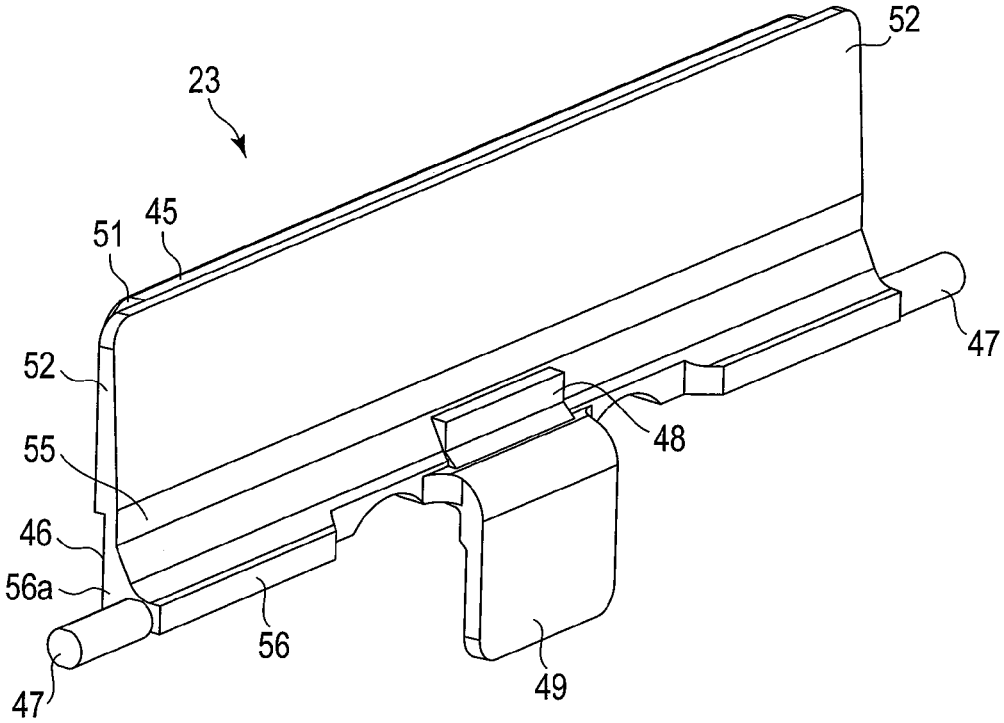
FIG. 5 is an exemplary perspective view of the button member taken from the side opposite that in FIG. 4.
Figure 6:
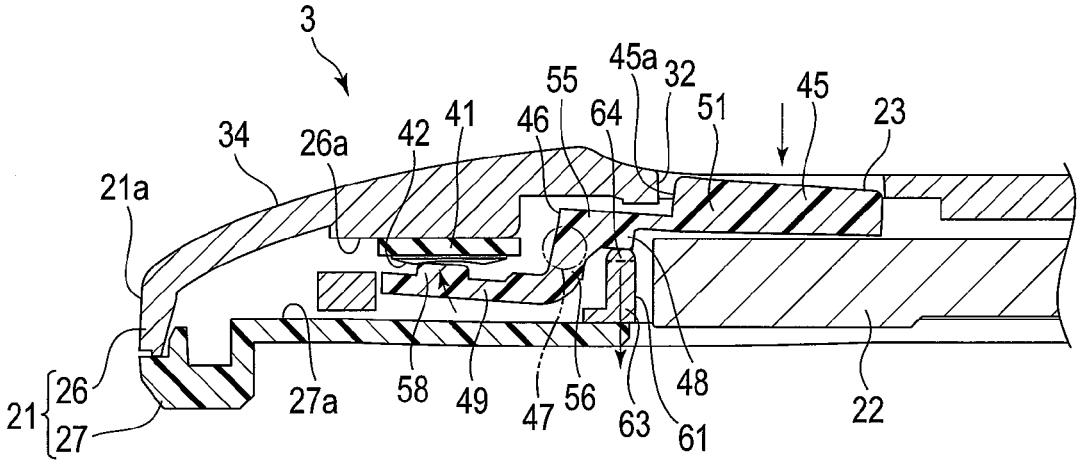
FIG. 6 is an exemplary sectional view showing part of the display section with the button member pivoted.

FIG. 4 is a perspective view showing the button member 23. FIG. 5 is a perspective view of the button member 23 taken from the side opposite that in FIG. 4. As shown in FIGS. 4 and 5, the button member 23 comprises an operating portion 45, intermediate portion 46, a pair of rocker shafts 47, abutting portion 48, and acting portion 49. The abutting portion 48 is an example of a part of a button. In FIGS. 3 and 6, one of the shafts 47 is indicated by a two-dot chain line.

The operating portion 45, intermediate portion 46, shafts 47, abutting portion 48, and acting portion 49 are integrally made of, for example, a synthetic resin. At least one of these portions 45 to 49 may be formed of a separate member.

As shown in FIG. 4, the operating portion 45 comprises a fitting portion 51 and engaging portion 52. The fitting portion 51 corresponds to the aperture 32 and is substantially rectangular. As shown in FIG. 3, the fitting portion 51 is fitted into and exposed through the aperture 32.

As shown in FIG. 4, the engaging portion 52 projects from side surfaces 51*a* of the fitting portion 51. The engaging portion 52 is located within the display housing 21 and contacts the inner surface 26*a* of the front cover 26.

As shown in FIG. 3, the operating portion 45 is superimposed over part of the display module 22 with a gap therebetween. In other words, the operating portion 45 is located above the display module 22. The operating portion 45 may be located above a circuit board or some other part than the display module 22.

Distance D1 between the inner surface 26*a* of the front cover 26 and an inner surface 27*a* of the rear cover 27 is greater than the thickness of the display module 22 in a position where the operating portion 45 is located. The inner surfaces 26*a* and 27*a* of the front and rear covers 26 and 27 face each other.

The above-described distance D1 is longer than distance D2 between the inner surfaces 26*a* and 27*a* of the front and rear covers 26 and 27 in a position (on the slope 34) where the switch 41 is located. In other words, the space in the display housing 21 in the position where the switch 41 is located is smaller than that in the position where the operating portion 45 of the button member 23 is located.

The intermediate portion 46 is disposed in the display housing 21 and coupled to a lower end portion 45*a* of the operating portion 45. The lower end portion 45*a* of the operating portion 45 is a part that is directed toward the main body 2 when the display section 3 is located in the first position. The intermediate portion 46 comprises first and second parts 55 and 56.

The first part 55 is coupled to the lower end portion 45*a* of the operating portion 45. The first part 55 extends along the operating portion 45 and the inner surface 26*a* of the front cover 26 toward the lower end portion 21*a* of the display housing 21.

The second part 56 extends from an end of the first part 55 toward the rear cover 27. In other words, the second part 56 extends substantially perpendicular to the first part 55.

As shown in FIG. 4, the pair of shafts 47 are individually disposed at the second part 56 of the intermediate portion 46. In other words, the shafts 47 are coupled to the operating portion 45 through the intermediate portion 46. Alternatively, the shafts 47 may be disposed at the first part 55.

The shafts 47 are columnar and project individually from opposite side surfaces 56*a* of the second part 56. The shafts 47 are coaxial with each other and extend transversely relative to the display housing 21.

The shafts 47 are pivotably held on the display housing 21. For example, the shafts 47 are fitted individually in grooves in the display housing 21. Alternatively, shafts 47 may be indirectly held on the display housing 21 by being held by means of another part that is attached to the display housing 21.

As shown in FIG. 5, the abutting portion 48 is provided on the intermediate portion 46. The abutting portion 48 is located in the transversely central part of the intermediate portion 46. As shown in FIG. 3, the abutting portion 48 protrudes from the first part 55 of the intermediate portion 46 toward the rear cover 27. The abutting portion 48 is located between the operating portion 45 and shafts 47. The abutting portion 48 is flat and faces the rear cover 27.

The acting portion 49 is coupled to an end of the second part 56 of the intermediate portion 46. In other words, the acting portion 49 is coupled to the shafts 47 through the intermediate portion 46. The intermediate portion 46 is interposed between the acting portion 49 and operating portion 45.

The acting portion 49 extends from the aforesaid end of the second part 56 toward the lower end portion 21*a* of the display housing 21. In other words, the acting portion 49 extends substantially perpendicular to the second part 56. In still other words, the acting portion 49 extends opposite to the operating portion 45 and display module 22.

The acting portion 49 comprises a pressing portion 58. The pressing portion 58 is a protuberance projecting toward the inner surface 26*a* of the front cover 26. The pressing portion 58 faces the belleville spring portion 42 of the switch 41 with a gap therebetween.

As described above, the button member 23 is substantially S-shaped and comprises the pair of shafts 47 at its substantially central part. If the user depresses the operating portion 45, the button member 23 rocks like a seesaw around the shafts 47.

As shown in FIG. 3, a supporting member 61 is disposed in the display housing 21. The supporting member 61 is an example of a supporting portion and is also referred to as a restraining portion, supporting portion, or holding portion. The supporting member 61 is attached to the inner surface 26*a* of the display housing 21 by, for example, screws or deposition.

The supporting member 61 comprises a beam portion 63 and protuberance 64. In FIGS. 3 and 6, the beam portion 63 and protuberance 64 are divided by a broken line. The beam portion 63 and protuberance 64 are integrally made of a metal, such as iron. Alternatively, they may be formed of separate members.

The beam portion 63 is located opposite the abutting portion 48 of the button member 23. The beam portion 63 extends transversely relative to the intermediate portion 46 of the button member 23. In other words, the beam portion 63 extends parallel to the shafts 47.

The protuberance 64 is in the form of a dome protruding from the beam portion 63 toward the inner surface 26*a* of the front cover 26. The protuberance 64 is located corresponding to the abutting portion 48 of the button member 23 and contacts the abutting portion 48. In other words, the protuberance 64 contacts part of the button member 23 between the operating portion 45 and shafts 47.

The first part 55 of the intermediate portion 46 and the abutting portion 48 are located between the protuberance 64 and the inner surface 26*a* of the front cover 26. In other words, the first part 55 passes between the inner surface 26*a* of the front cover 26 and the protuberance 64.

As shown in FIG. 4, the acting portion 49 is smaller than the operating portion 45. In other words, the acting portion 49 is lighter in weight than the operating portion 45. Further, the distance from each shaft 47 to an end of the acting portion 49 is shorter than that from each shaft 47 to an end of the operating portion 45. If the display section 3 is located in, for example, the second position, therefore, the button member 23 is urged to pivot under its own weight.

As shown in FIG. 3, the protuberance 64 supports the button member 23, which is urged to pivot in the above-described manner, by contacting the abutting portion 48. Thus, the button member 23 is supported by the grooves in the display housing 21, which hold the shafts 47, and the protuberance 64. In this way, the button member 23 is restrained from pivoting about the shafts 47.

FIG. 6 is a sectional view showing part of the display section 3 with the button member 23 pivoted. If the operating portion 45 of the button member 23 is depressed by, for example, the user's finger, as shown in FIG. 6, the abutting portion 48 of the button member 23 presses the protuberance 64.

When the protuberance 64 is pressed, the beam portion 63 is bent together with the rear cover 27. In other words, the beam portion 63 is elastically deformed by the button member 23 that pivots about the shafts 47.

The beam portion 63 elastically deformed permits the button member 23 to pivot about the shafts 47. Thereupon, the operating portion 45 moves inwardly relative to the display housing 21, and the acting portion 49 moves toward the switch 41.

The pressing portion 58 of the acting portion 49 pivoting about the shafts 47 presses the belleville spring portion 42 of the switch 41. Pressed by the pressing portion 58, the spring portion 42 is elastically deformed. Thereupon, the switch 41 is activated so that, for example, the menu screen of the OS is called up as aforesaid. As the spring portion 42 is elastically deformed, moreover, the user can get a click feeling.

If the user releases the finger from the operating portion 45 so that the pressing force is removed from the operating portion, the elastically deformed beam portion 63 is returned to its original position. When this is done, the elastic force of the beam portion 63 causes the protuberance 64 to press the abutting portion 48 of the button member 23, thereby pivoting the button member 23.

As the button member 23 is pivoted, the operating portion 45 moves to the outside of the display housing 21, whereupon the acting portion 49 is separated from the switch 41. Thus, the button member 23 is returned to its original position. Further, the belleville spring portion 42 of the switch 41 is restored to its original shape.

According to the portable computer 1 of the one embodiment described above, the switch 41 is located in the display housing 21 and activated by the button member 23 that pivots about the shafts 47. Therefore, the switch 41 need not be located just below the operating portion 45 of the button member 23.

The supporting member 61 supports the button member 23 so that the button member 23 is restrained from pivoting. After the button member 23 is pivoted, the supporting member 61 returns the button member 23 to the original position by means of its elastic force. This can suppress a malfunction of the switch 41 and degradation of the external appearance of the portable computer 1 due to failure of the button member 23 to return. For example, if the operating portion 45 is larger than the acting portion 49 as described above, the button member 23 is urged to pivot by its own weight. Since the supporting member 61 supports the button member 23, however, the operating portion 45 is restrained from freely pivoting under its own weight.

Various components, such as the display module 22 and switch 41, are densely arranged in the portable computer 1. As described above, therefore, the operating portion 45 can be larger than the acting portion 49. According to the portable computer 1, however, the operating portion 45 is restrained from freely pivoting under its own weight. Thus, problems that may be caused when the switch 41 is located in a position other than just below the operating portion 45 can be suppressed, so that the flexibility of arrangement of the button member 23 and switch 41 can be improved.

The switch 41 is located on the inner surface 26*a* of the front cover 26 with the aperture 32. In other words, the switch 41 is located in a position other than just below the operating portion 45 of the button member 23. Thus, the button member 23 and switch 41 can be properly arranged even if the display module 22 or other components are arranged below the operating portion 45 of the button member 23. Since the button member 23 and switch 41 do not overlap thicknesswise relative to the display section 3, moreover, the portable computer 1 can be made thinner.

Part of the button member 23 is located between the supporting member 61 and the inner surface 26*a* of the front cover 26. Thus, the protuberance 64 of the supporting member 61 supports the operating portion 45 in a direction opposite that in which the user depresses the operating portion 45. Accordingly, the transverse central part of the button member 23 can be kept from bending when the operating portion 45 is depressed.

The protuberance 64 of the supporting member 61 contacts the abutting portion 48 that is located between the operating portion 45 and shafts 47. Based on the principle of leverage, therefore, force greater than the pressing force on the operating portion 45 acts on the beam portion 63 and protuberance 64. Thus, the beam portion 63 can be easily elastically deformed, and the button member 23 can easily pivot when the operating portion 45 is depressed.

The engaging portion 52 of the operating portion 45 contacts the inner surface 26*a* of the front cover 26. Thus, the operating portion 45 can be kept from unduly projecting from the aperture 32, and the button member 23 restrained from pivoting.

The space in the display housing 21 in the position where the switch 41 is located is smaller than that in the position where the operating portion 45 of the button member 23 is located. In other words, the switch 41 is disposed in a small space. Thus, a large space can be secured in the display section 3.

The operating portion 45 of the button member 23 is superimposed over the display module 22 with a gap therebetween. Accordingly, the operating portion 45 can be located even in the place where the display module 22 is disposed. Thus, the flexibility of arrangement of the button member 23 and switch 41 can be improved.

The acting portion 49 of the button member 23 extends opposite to the display module 22.

Accordingly, a large space can be secured for the location of the display module 22.

According to at least one electronic apparatus described above, the supporting portion supports the button member to thereby restrain pivoting of the button member, and the button member is returned to its original position by elastic force when it is pivoted. Thus, the flexibility of arrangement of the button member and switch can be improved.

For example, the electronic apparatus is not limited to the portable computer 1 and may alternatively be various other apparatuses, such as a cellphone, smartphone, portable music player, etc. Further, the supporting portion may be, for example, an elastic body disposed on the inner surface of a cover and located between a button member and the cover.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic apparatus comprising:

a housing comprising an opening;

a switch in the housing, the switch configured to be actuated when depressed;

a button member comprising:

an operating portion exposed through the opening;

a rocker shaft coupled to the operating portion inside the housing and pivotably held by the housing; and an acting portion coupled to the rocker shaft, configured to face the switch, and configured to pivot about the rocker shaft, thereby pressing the switch, when the operating portion is depressed; and a supporting portion in the housing and configured to support the button member to thereby restrain pivoting of the button member, the supporting portion being configured to be elastically deformed by part of the button member so that the button member is pivoted about the rocker shaft when the operating portion is pressed and to return the button member when a force applied to the operating portion is removed.

2. The electronic apparatus of claim 1, wherein the housing comprises a cover comprising the opening, the switch being disposed on an inner surface of the cover.

3. The electronic apparatus of claim 2, wherein part of the button member is located between the supporting portion and the inner surface of the cover.

4. The electronic apparatus of claim 3, wherein the supporting portion contacts part of the button member between the rocker shaft and the operating portion.

5. The electronic apparatus of claim 4, further comprising an engaging portion in the operating portion, the engaging portion configured to contact the inner surface of the cover.

* * * * *